United States Patent [19]

Fricker

[11] Patent Number: 4,720,952

[45] Date of Patent: Jan. 26, 1988

[54] DEVICE FOR ANCHORING SLABS

[76] Inventor: Siegfried Fricker, Wurmberger Strasse 30-34, D-7135 Wiernsheim, Fed. Rep. of Germany

[21] Appl. No.: 33,693

[22] Filed: Apr. 3, 1987

[30] Foreign Application Priority Data

Apr. 3, 1986 [DE] Fed. Rep. of Germany ..... 3611072

[51] Int. Cl.[4] ..... E04B 1/38

[52] U.S. Cl. ..... 52/235; 52/508; 52/713; 52/741; 248/231.91; 403/380; 403/87

[58] Field of Search ..... 52/235, 508, 511, 713, 52/741; 248/231.91; 403/380, 87

[56] References Cited

U.S. PATENT DOCUMENTS 4,570,401 2/1986 Vebel et al. ..... 56/235
4,625,481 12/1986 Crandell ..... 52/235

FOREIGN PATENT DOCUMENTS 2543174 3/1977 Fed. Rep. of Germany ..... 52/235
7811240 5/1979 Netherlands ..... 52/235

*Primary Examiner*—Carl D. Friedman
*Attorney, Agent, or Firm*—Schwartz, Jeffery, Schwaab, Mack, Blumenthal & Evans

[57] ABSTRACT

An anchoring device comprising an angular holder and a support member. The angular holder has a vertical holding portion, a horizontal supporting portion and a plurality of teeth. A toothed portion of the support member engages the teeth of the supporting portion. The teeth of the supporting part and/or the toothed portion of the support member are arcuate. The support member is adjustable on the supporting portion in a horizontal plane both in a longitudinal and transverse direction.

21 Claims, 6 Drawing Figures

Fig. 2
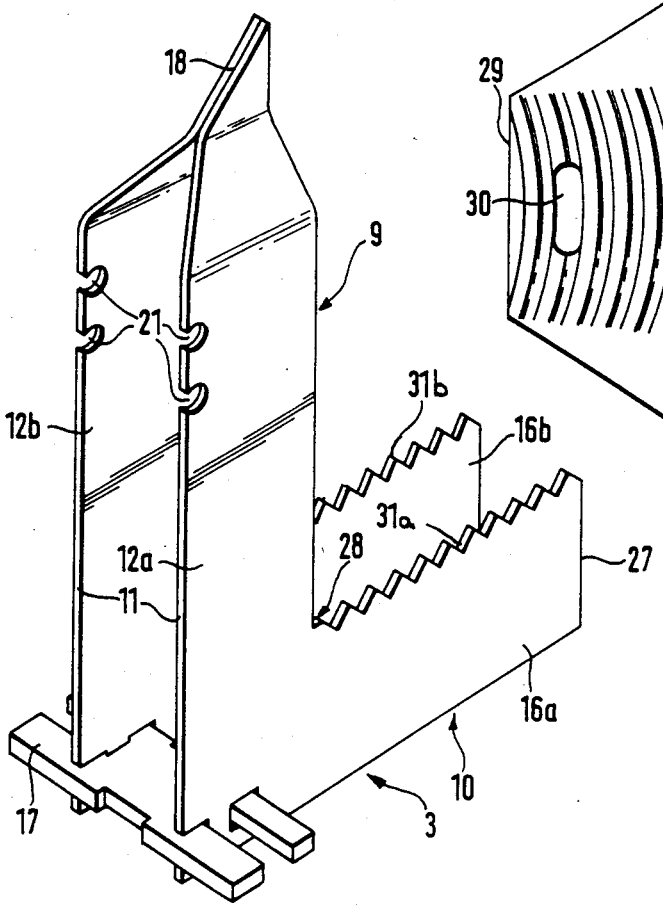
Fig. 3
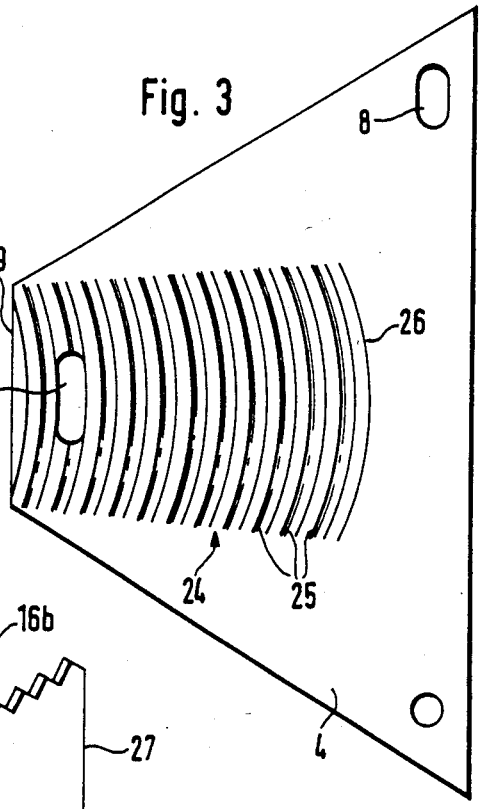
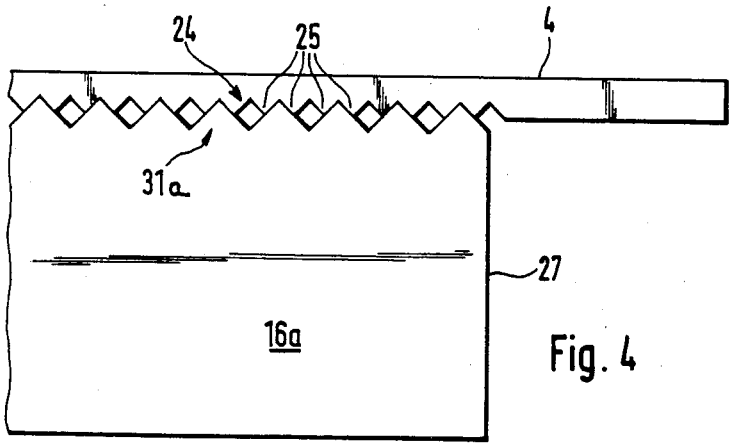
Fig. 4

DEVICE FOR ANCHORING SLABS

BACKGROUND OF THE INVENTION

The invention relates to anchoring devices for anchoring slabs generally, and more particularly to anchoring devices having holders and support members.

In known devices of the above type, the support member sits on a horizontal supporting portion of an angular holder. The support members are detachably affixed to the facing slab so that the latter may be held at a distance from a wall of a building or the like. The horizontal supporting portion and the support member have teeth which face toward one another and are intermeshed. When the connecting screw is slackened, the support can be adjusted in the horizontal plane perpendicularly toward the wall of the building in increments corresponding with the minimum spacing of the teeth. In addition, the support can likewise be displaced parallel to the wall of the building in the horizontal plane at right angles to the abovementioned adjusting direction within the engagement of the tooth system, so that the facing slabs can be aligned within a certain distance in two directions running at right angles to one another.

SUMMARY OF THE INVENTION

An object of the invention is to provide a device for anchoring slabs having an additional degree of adjustment in the area of the locking tooth system between the supporting portion of the holder and the support member so that the slabs to be assembled can be accurately aligned relative to one another and with respect to the wall of the building.

These and other objects are achieved by the present invention which provides an anchoring device adapted to anchor a first structure to a second structure, comprising a support member including a toothed support portion and means for engaging the first structure, a holder member including the toothed holder portion engageable with the toothed support portion and an element for engaging the second structure, and an adjustable element for securely engaging the toothed support portion with the toothed holder portion. At least one of the toothed support portion and the toothed holder portion has a plurality of arcuate teeth, whereby the support and holder members may be pivoted relative to one another and then secured.

Furthermore, there is provided an arcuate slot in the support which receives a securing bolt, yet permits angular adjustment between the holder and the support member.

BRIEF DESCRIPTION OF THE DRAWINGS

Preferred embodiments of the present invention are described with reference to the drawings, in which:

FIG. 2 is a perspective view of the holder of the anchoring device of FIG. 1;

FIG. 3 is a bottom planar view of the trapezoidal-plate support of the holding device of FIG. 1;

FIG. 4 is a side view of the front part of the anchoring device of FIG. 1 and its locking tooth system;

Figure 1:
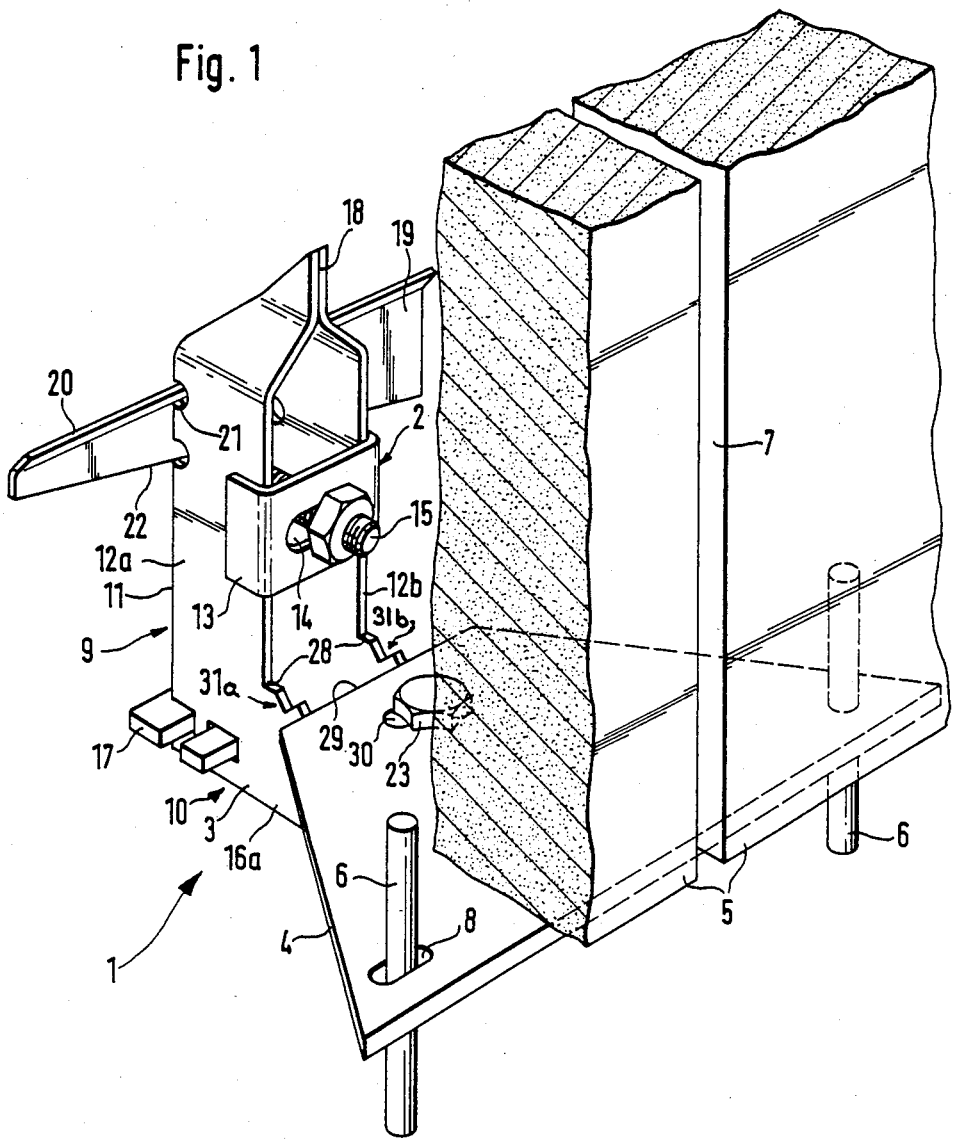
FIG. 1 is a perspective view of an anchoring device according to a preferred embodiment of the invention.

In the drawings, equivalent features of different embodiments are given the same primed and unprimed designations.

DETAILED DESCRIPTION OF THE PREFERRED EMBODIMENTS

Referring to FIG. 1, the anchoring device 1 according to a first preferred embodiment of the present invention is fixed via an anchoring element 2 to a veritcal anchoring base (not shown) such as the wall of a building or the like. For this purpose, the anchoring device includes an angular holder 3 which is provided with a support 4. The support 4 is preferably a trapezoidal plate. Secured in position on the support 4 are vertical facing slabs 5 which are spaced approximately parallel to the supporting wall (FIG. 1). The anchoring device 1, in addition to absorbing the forces associated with the weight of the facing slabs 5, also absorbs the applied suction or pressure loads caused by the weather or other working loads or the like. The facing slabs 5 can be secured in position via bolt-shaped locating pieces 6 which are provided in the front corner areas of the trapezoidal plate 4 and engage into the facing slabs 5. A seam 7 may exist between two adjacent facing slabs 5. In addition, for accommodating tolerances, one of the bolt-shaped locating pieces 6 is arranged in an oblong hole 8. The angular holder 3 has a vertical holding portion 9 and a horizontally projecting supporting portion 10. The rearward portion 11 of the holding portion 9 faces toward the supporting wall, to which the anchoring device 1 is secured in position.

In the holder 3 shown in FIG. 1 and 2, the vertical holding portion 9 has two parallel, flat holding struts **12*a* and 12*b* disposed perpendicularly to the surface of the anchoring base. Extending across the holding struts 12*a* and 12*b* is the anchoring element 2, which is preferably made as a screw bolt connection. For this purpose, a U-shaped strap 13 formed from a flat bar is advantageously provided, which grips over the two holding struts 12*a* and 12*b*. The strap 13 is provided with a slotted hole 14 through which the screw bolt 15** extends and which enables a tolerance to be accommodated in the horizontal direction.

The horizontal supporting portion 10 of the angular holder 3 likewise comprises two supporting struts **16*a* and 16*b* which are parallel to one another. The vertical holding struts 12*a* and 12*b* and the horizontal supporting struts 16*a* and 16*b* in each case lie in common vertical parallel planes. The struts are preferably constructed from planar punched strips. The holding struts 12*a* and 12*b* and/or the horizontal supporting struts 16*a* and 16*b* can be connected by suitable stiffening members 17 into a stable, rigid device. At the top, the holding struts 12*a* and 12*b* are bent toward one another and are connected to one another preferably by a welded joint 18** which preferably is a spot weld.

So that the anchoring device 1 can easily be infinitely adjusted vertically, a wedge plate 19 is provided which has an edge 20. The edge 20 is bent over toward the holder 3 and engages into corresponding recesses 21 on the rear side of the holding struts **12*a* and 12*b*. The lower edge 22 of the wedge plate 19 is inclined at a slope and rests on the screw bolt 15. The anchoring device 1 is vertically adjusted by horizontal displacement of the wedge plate 19**.

The trapezoidal plate 4 sitting on the horizontal supporting portion 10 is detachably fixed to the supporting portion 10 by a screw 23 and a strap (not shown) which grips beneath the supporting part 10 in a manner similar to that of the bolt 15 and strap 13 on the vertical holding portion 9. A toothed surface portion 24 is provided on the underside of the trapezoidal-plate support 4 (Fig. 3). The toothed portion 24 is preferably formed from a plurality of parallel, equally spaced teeth 25. The spacing of the teeth 25, that is, their distance from one another, is relatively small. The toothed portion 24 can be advantageously pressed or rolled into the underside of the trapezoidal plate 4. Of course it is also possible, instead of providing a finely toothed part 24, to provide a coarser toothed portion 24 with larger spacing.

Referring to FIG. 3, the toothed portion 24 is formed according to a circular arc 26; that is, all teeth 25 of the toothed portion 24 have a curved shape, such that the radius for all teeth 25 provides a circular arc shape that is always the same size so that the teeth 25 lie exactly parallel to one another. In the present exemplary embodiment, the circular arc 26 of the teeth 25 is made such that the curvature of the circular arc 26 extends toward the free end 27 of the supporting part 10. But it is also possible to make the toothed portion 24 arc in exactly the opposite direction so that the curvature of the circular arc portion 26 extends toward the angled corner area 28 of the holder 3. In addition, the length of the circular arc portion 26 is slightly larger near the free end 27 than at the edge 29 facing toward the angled corner area 28, so that the toothed portion 24 is slightly wider at the end remote from the angled corner area 28 than at the edge 29 of the support 4.

The support 4 is provided with a slotted hole 30 in an area of the toothed portion 24. The slotted hole 30 receives the screw 23 so that the latter may extend through the trapezoidal plate 4. The slotted hole 30 curves along a path corresponding to the circular arc 26.

Referring to FIGS. 1, 2 and 4, teeth 31*a* and 31*b* are provided on each upper edge portion of the two supporting struts 16*a* and 16*b* of the supporting portion 10, respectively. The teeth 31*a* and 31*b* run straight and parallel to one another in accordance with the alignment of the supporting struts 16*a* and 16*b*. The width of the teeth 31*a* and 31*b* is extremely narrow and approximately corresponds to the width of the supporting struts 16*a* and 16*b*.

Referring particularly to FIG. 4, the teeth 31*a* and 31*b* are substantially coarser and therefore have a large spacing between their teeth than is the case in the toothed portion 24 of the trapezoidal plate 4. Consequently, the teeth 31*a* and 31*b* can be easily produced on the narrow side of the supporting struts 16*a* and 16*b* by punching without risk of damage, tooth break or premature wear of the punching tool, as would be feared when punching a fine tooth system. Although the clearly coarser teeth 31*a* and 31*b* are provided with a substantially larger tooth spacing in the supporting portion 10 than is the case in the toothed portion 24 in the support 4, there is nevertheless the full advantage of a closely stepped locking tooth system effected by the fine tooth system of the toothed portion 24. According to the representation in FIG. 4, the spacing of the teeth 31*a* and 31*b* is twice as large as that in the toothed portion 24 so that, with regard to the manufacture of the teeth 31*a* and 31*b*, there is the important advantage that the teeth 31*a* and 31*b* can also be punched out of relatively thick plate or flat bar. Such a locking tooth system, with a fine toothed portion 24 corresponding with coarse teeth 31*a* and 31*b*, can be used not only advantageously in a toothed portion 24 made according to the preferred embodiment in a circular arc shape, but can also be expediently used in such applications in which exclusively straight toothed portions 24 and straight teeth 31*a* and 31*b* are intermeshed.

Figure 6:
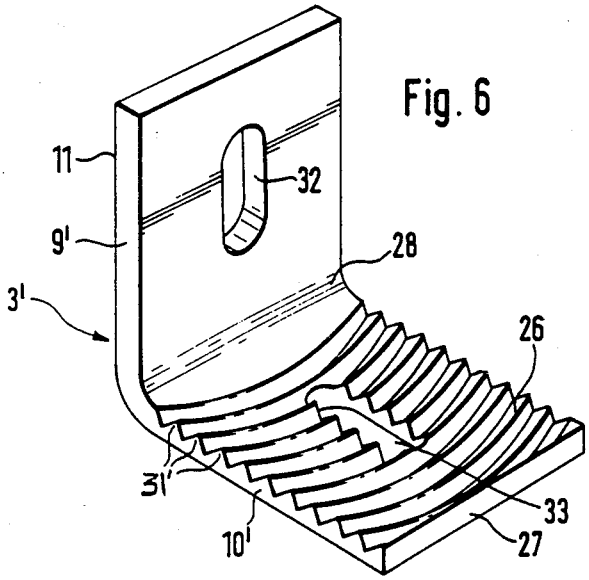
FIG. 6 is a perspective view of the angular holder of the anchoring device of FIG. 5.
Figure 5:
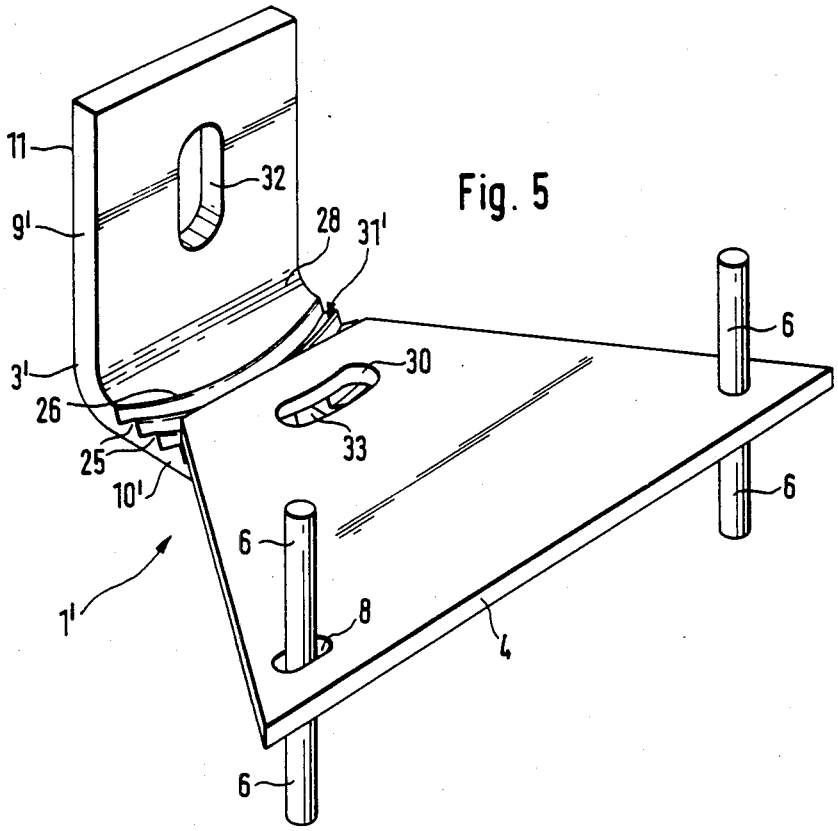
FIG. 5 is a perspective view of an anchoring device according to another preferred embodiment of the invention in perspective representation.

Referring to FIGS. 5 and 6, an anchoring device 1' of a second preferred embodiment includes a trapezoidal-plate support 4 which is the same as in the first embodiment of FIGS. 1 to 4 and therefore has on its underside the toothed portion 24 (not visible here) which is made in a circular arc shape according to FIG. 3. The angular holder 3' is a simpler design and includes two flat-bar legs bent over toward one another at an angle of 90°, with the vertical leg forming the holding portion 9' to be fixed on the anchoring base and the horizontal leg forming the supporting portion 10' which receives the trapezoidal-plate support 4. In the holding part 9', a slotted hole 32 is made which is elongated in the vertical direction and through which the screw bolt 15 (not shown here) extends for effecting attachment to the anchoring base. The holder 3' can be infinitely adjusted vertically as a result of the slotted hole 32. In the horizontal supporting portion 10', an additional slotted hole 33 is made which is located in the area of, and is elongated in, a direction defined between the angled corner area 28 and the free end 27. The support 4 and the supporting part 10' are preferably connected by the screw 23 (not shown) which extends through the slotted hole 30 in the trapezoidal plate 4 and the slotted hole 33 in the supporting portion 10.

The tooth system 31' is provided on nearly the entire upper surface of the supporting portion 10', which upper surface faces toward the support 4, with the teeth 31' following a circular arc corresponding with the circular arc 26 of the support 4. The curvature of the teeth 31' extends toward the free end 27 of the supporting portion 10'. The teeth 31' preferably form a fine tooth system which essentially corresponds with the toothed portion 24 of the trapezoidal plate 4. The circular arcs defined by teeth 31' and the toothed portion 24 are substantially identical. However, it is also within the scope of the invention to make the toothed portion 24 of the trapezoidal plate 4 and the teeth 31' of the supporting part 10' with different tooth spacings. For example, the teeth 31' in the supporting part 10' could be made twice as coarse. In the present embodiment, the teeth 31' can be advantageously pressed or rolled into the surface of the supporting portion 10'.

An important advantage of the circular-arc-shaped tooth system according to the invention is that the support or the trapezoidal plate 4 on which the facing slabs 5 are held can be adjusted in the horizontal plane perpendicularly and parallel to the wall (anchoring base) of the building and, in addition, can be swiveled in accordance with the radius or circular arc path of the toothed part 24 and/or the teeth 31', so that further infinite adjustment is possible for exact alignment of the facing slabs 5. The walls of buildings are often not exactly flat nor planar, so that the angular holders 3, 3' are caused to rest exactly obliquely or in an inclined position against the outside of the wall. So that the facing slabs 5 can be assembled accurately in a common plane with uniform seam widths, the holder 3 of the anchoring device 1 can be infinitely adjusted vertically with the wedge plate 19 and horizontally with the strap 13, the screw bolt 15 and the slotted hole 14. In the anchoring device 1', the holder 2' can be infinitely adjusted vertically with the slotted hole 32.

If the screw 23 is slackened slightly, the support 4 can be adjusted in the horizontal plane in the longitudinal direction of the horizontal supporting portion 10, 10', so that the distance between the wall of the building and the facing slabs 5 can be adjusted in fine steps in accordance with the smallest tooth spacing. In addition, it is possible to infinitely swivel the support 4 both to the left and to the right in the horizontal plane transversely to the longitudinal direction of the supporting portion 10, 10' with the curved slotted hole 30. In so doing, the circular-arc-shaped tooth system remains in engagement when all radii of the circular arc teeth 25 are the same size but each individual radius has its own center. The locking tooth system assures that the facing slabs 5 are securely held, even under the effect of powerful external forces such as squalls or the like.

A further adaptation for maintaining a uniformly wide seam 7 is achieved by the slotted hole 8 made in the trapezoidal plate 4. If the holes for the bolt-shaped locating pieces 6 in the facing slabs 5 are predrilled accurately and the seam size is to be changed, for example, from 5 mm to 4 mm width, this can be achieved by the accommodation provided by the oblong configuration of the hole 8. On the whole, as a result of the disclosed anchoring device, an optimally variable anchoring system is available which can be adjusted in many different ways for aligning the facing slabs 5 accurately in parallel planes.

It is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. An anchoring device adapted to anchor a first structure to a second structure, comprising:

a support member including a toothed support portion and means for engaging a first structure;

a holder member including a toothed holder portion engageable with said toothed support portion and means for engaging a second structure; and adjustable means for securely engaging said toothed support portion with said toothed holder portion, at least one of said toothed support portion and said toothed holder portion having a plurality of arcuate teeth such that said support and holder members may be engaged to one another at different angles.

2. The anchoring device as claimed in claim 1, wherein said means for engaging the second structure includes adjustment means for adjusting said holder member vertically in position relative to said second structure.

3. The anchoring device as claimed in claim 2, wherein said adjustable means for securely engaging said toothed support portion with said toothed holder portion includes adjustment means for moving said holder and support members radially apart with respect to plurality of arcuate teeth means.

4. The anchoring device as claimed in claim 3, wherein said means for engaging the first structure includes adjustment means for adjusting said support member horizontally in position relative to said first structure.

5. The anchoring device as claimed in claim 4, wherein said plurality of arcuate teeth are mutually parallel and circularly arcuate.

6. A device for anchoring bodies such as facing slabs or the like, on an anchoring base such as a wall of a building or the like, comprising an angular holder, a support member and adjustable means for securing said support member to said angular holder, said angular holder comprising a vertical holding portion adapted to be secured in position on an anchoring base and a horizontally extending supporting portion provided with a plurality of teeth, said support member provided with at least one locating means for engaging bodies and a toothed portion engaging the teeth of the supporting portion, said adjustable securing means securing said support member in a generally horizontal plane and being longitudinally and transversely adjustable, at least one of said teeth on said supporting portion and said toothed portion of said support portion comprising a plurality of circularly arcuate teeth.

7. The device as claimed in claim 6, wherein the circularly arcuate teeth are parallel.

8. The device as claimed in claim 6, wherein the circularly arcuate teeth have substantially equal radii of curvature.

9. The device as claimed in claim 6, wherein said supporting portion includes a free end and the plurality of teeth extend convexly toward the free end of the supporting portion.

10. The device as claimed in claim 6, wherein the teeth of the supporting part and the toothed portion of the support member both comprise a plurality of circularly arcuate teeth of similar form.

11. The device as claimed in claim 10, wherein the toothed portion comprises circularly arcuate teeth and is provided with a slotted hole approximately conforming in curvature with the circularly arcuate teeth, said slotted hole receiving a fixing screw, the support member comprising a trapezoidal plate.

12. The device as claimed in claim 10, wherein the toothed portion comprises circularly arcuate teeth, said toothed portion having a first portion adjacent a free end portion of the supporting portion and a second portion adjacent a corner portion of the holder, said first portion wider than said second portion.

13. The device as claimed in claim 6, wherein the supporting portion includes horizontal supporting struts and wherein the toothed portion of the support member and the teeth of the supporting portion differ in configuration, with the toothed portion comprising circularly arcuate teeth in engagement with teeth arranged along an upper edge portion of at least one supporting strut of the supporting portion.

14. The device as claimed in claim 11, wherein the teeth of said supporting portion are arranged along parallel upper edges of two supporting struts.

15. The device as claimed in claim 13, wherein the toothed portion comprises circularly arcuate teeth and is provided with a slotted hole approximately conforming in curvature with the circularly arcuate teeth, said slotted hole receiving a fixing screw, the support member comprising a trapezoidal plate.

16. The device as claimed in claim 13, wherein the toothed portion comprises circularly arcuate teeth, said toothed portion having a first portion adjacent a free end portion of the supporting portion and a second portion adjacent a corner portion of the holder, said first portion wider than said second portion.

17. The device as claimed in claim 6, wherein spacing between the teeth of the supporting portion is different from spacing between the teeth of the toothed portion of the support member.

18. The device as claimed in claim 17, wherein the teeth of the supporting portion has the larger spacing and are punched from an edge portion of a supporting strut of the supporting portion.

19. The device as claimed in claim 6, wherein the toothed portion comprises circularly arcuate teeth and is provided with a slotted hole approximately conforming in curvature with the circularly arcuate teeth, said slotted hole receiving a fixing screw, the support member comprising a trapezoidal plate.

20. The device as claimed in claim 6, wherein the toothed portion comprises circularly arcuate teeth, said toothed portion having a first portion adjacent a free end portion of the supporting portion and a second portion adjacent a corner portion of the holder, said first portion wider than said second portion.

21. A method of anchoring a slab to an anchoring base, comprising the steps of:

affixing a holder member having a toothed portion to said anchoring base;

affixing a support member having a toothed portion to said slab;

engaging and adjusting an angular relationship between said holder and support members by contacting the toothed portions on each of said holder and support members, at least one toothed portion being arcuate; and securing said holder and support members together.

* * * * *